US006102833A

United States Patent [19]

Chen

[11] Patent Number: 6,102,833

[45] Date of Patent: Aug. 15, 2000

[54] DEVICE FOR EXERCISING WAIST AND LEGS

[76] Inventor: James Chen, No. 35 Tun Hi Rd., Chin Chan Li, Sa Lu, Taichung, Taiwan

[21] Appl. No.: 09/305,026

[22] Filed: May 4, 1999

[51] Int. Cl.[7] ..... A63B 22/04

[52] U.S. Cl. ..... 482/53; 482/51; 482/52

[58] Field of Search ..... 482/52, 53, 51, 482/63, 71, 111, 80, 146, 147

[56] References Cited

U.S. PATENT DOCUMENTS 5,545,111 8/1996 Wang et al. ..... 482/53
5,628,709 5/1997 Chen ..... 482/53

*Primary Examiner*—Jerome W. Donnelly
*Assistant Examiner*—Tam Nguyen
*Attorney, Agent, or Firm*—Browdy and Neimark

[57] ABSTRACT

An exercise device comprises a base, two pedaling sets, and two damping apparatus. The base is formed of a front cross rod, a rear cross rod, a connection rod connecting the front cross rod and the rear cross rod, and a rotatable shaft fastened pivotally at one end thereof with the center of the front cross rod. The two pedaling sets are formed of two curved support rods and two pedals mounted on the support rods, and are fastened pivotally with two sides of the rotatable shaft. The pedaling sets turn along with the rotatable shaft. The base is provided with two arcuate protrusions located at two sides of the connection point of the front cross rod and the connection rod. The two support rods of the pedaling sets are respectively provided with a guide pillar. When the two pedaling sets are moved up and down, the arcuate protrusions are pressed against by the two guide pillars of the two support rods of the pedaling sets, thereby causing the two pedaling sets to turn sideways.

6 Claims, 4 Drawing Sheets

DEVICE FOR EXERCISING WAIST AND LEGS

FIELD OF THE INVENTION

The present invention relates generally to an exercise device, and more particularly to an exercise device for developing and training legs and waist simultaneously.

BACKGROUND OF THE INVENTION

A prior art device for exercising waist and legs comprises a pivoting tube for each of two pedals. Located under the pivoting tube is an urging block under which a first connection rod is horizontally disposed. The first connection rod is fastened pivotally with a second connection rod which is in turn fastened pivotally with a main support rod. When the two pedals move up and down in rotation, the main support rod remains stationary. As the pedals are moved downward, the urging blocks push the first connection rod and the second connection rod to swivel. This prior art device is defective in design in that the urging blocks, the first connection rod, and the second connection rod are vulnerable to jam, thereby resulting in high rate of mechanical breakdown.

Another prior art device for exercising waist and legs comprises a pedalling apparatus which is connected at the front end thereof with a straight rod which is in turn fastened horizontally with a connection rod mechanism. An upright rod is fastened with the connection rod mechanism such that the upright rod is connected with the radial periphery of a rotary disk. When two pedals are moved up and down, the connection rod mechanism is pushed by the straight rod such that the rotary disk is actuated to turn by the upright rod. This prior art device is composed of many component parts, such as the straight rod, the connection rod mechanism, an upright rod, a rotary disk, etc. These component parts are prone to move apart to result in the jamming of the prior art device.

SUMMARY OF THE INVENTION

The primary objective of the present invention is therefore to provide a device for exercising waist and legs at the same time. The device is simple in construction and is relatively free from the mechanical breakdown.

In keeping with the principle of the present invention, the foregoing objective of the present invention is attained by an exercise device comprising mainly a base, two pedaling sets, and two damping apparatus. The base is formed of a front cross rod, a rear cross rod, a connection rod connecting the front cross rod and the rear cross rod, and a rotatable shaft fastened pivotally at one end thereof with the center of the front cross rod. The two pedaling sets are formed of two curved support rods and two pedals, and are fastened pivotally with two sides of the rotatable shaft of the base. The two pedaling sets turn along with the rotatable shaft. The base is provided with two arcuate protrusions located at two sides of the connection point of the front cross rod and the connection rod. The two support rods of the pedaling sets are provided respectively with a guide pillar. When the two pedaling sets are moved up and down, the arcuate protrusions of the base are pressed against by the two guide pillars of the two support rods of the pedaling sets, thereby causing the two pedaling sets to turn leftward and rightward.

The foregoing objective, features, functions, and advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
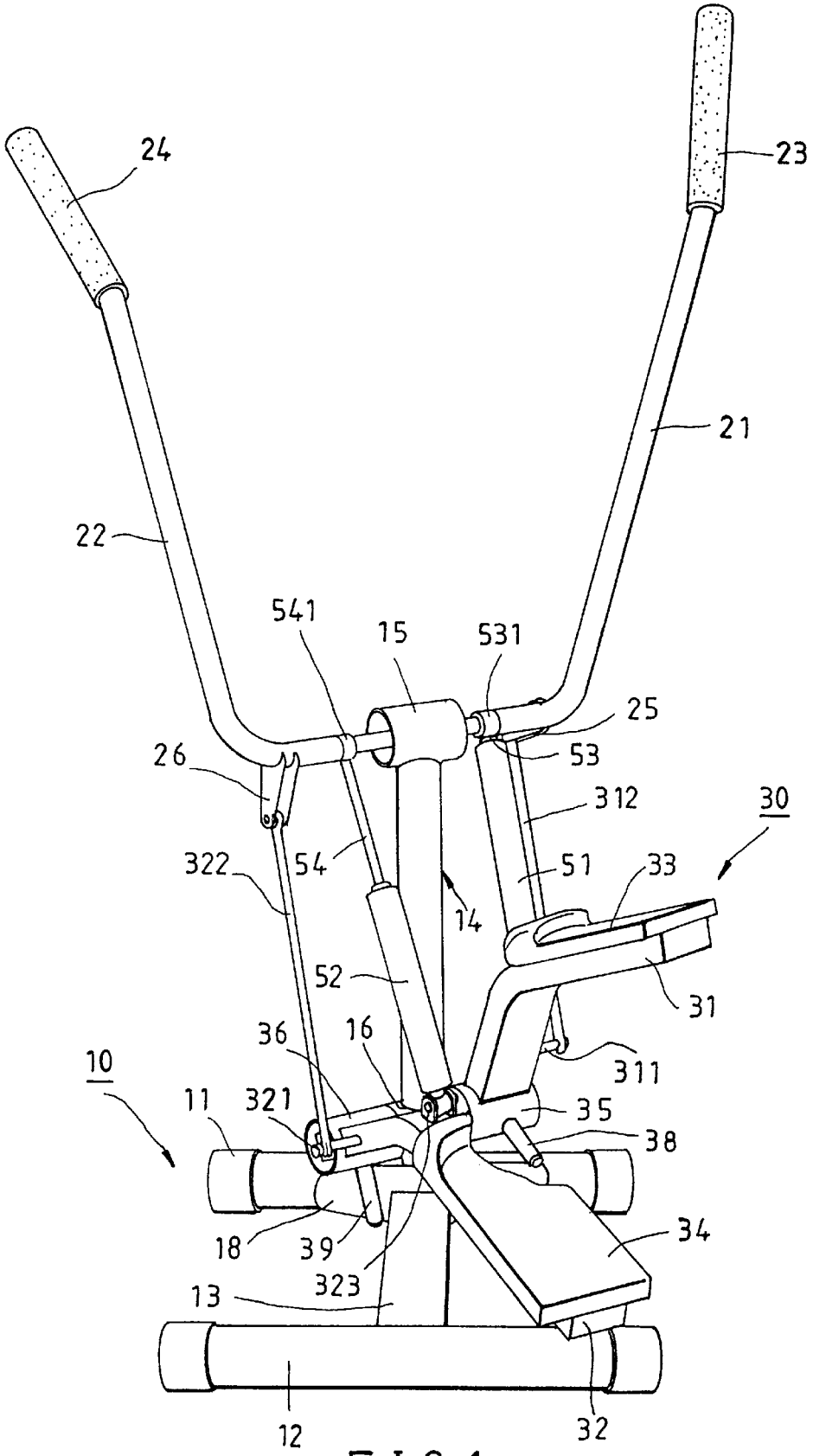
FIG. 1 shows a rear view of the preferred embodiment of the present invention.
Figure 2:
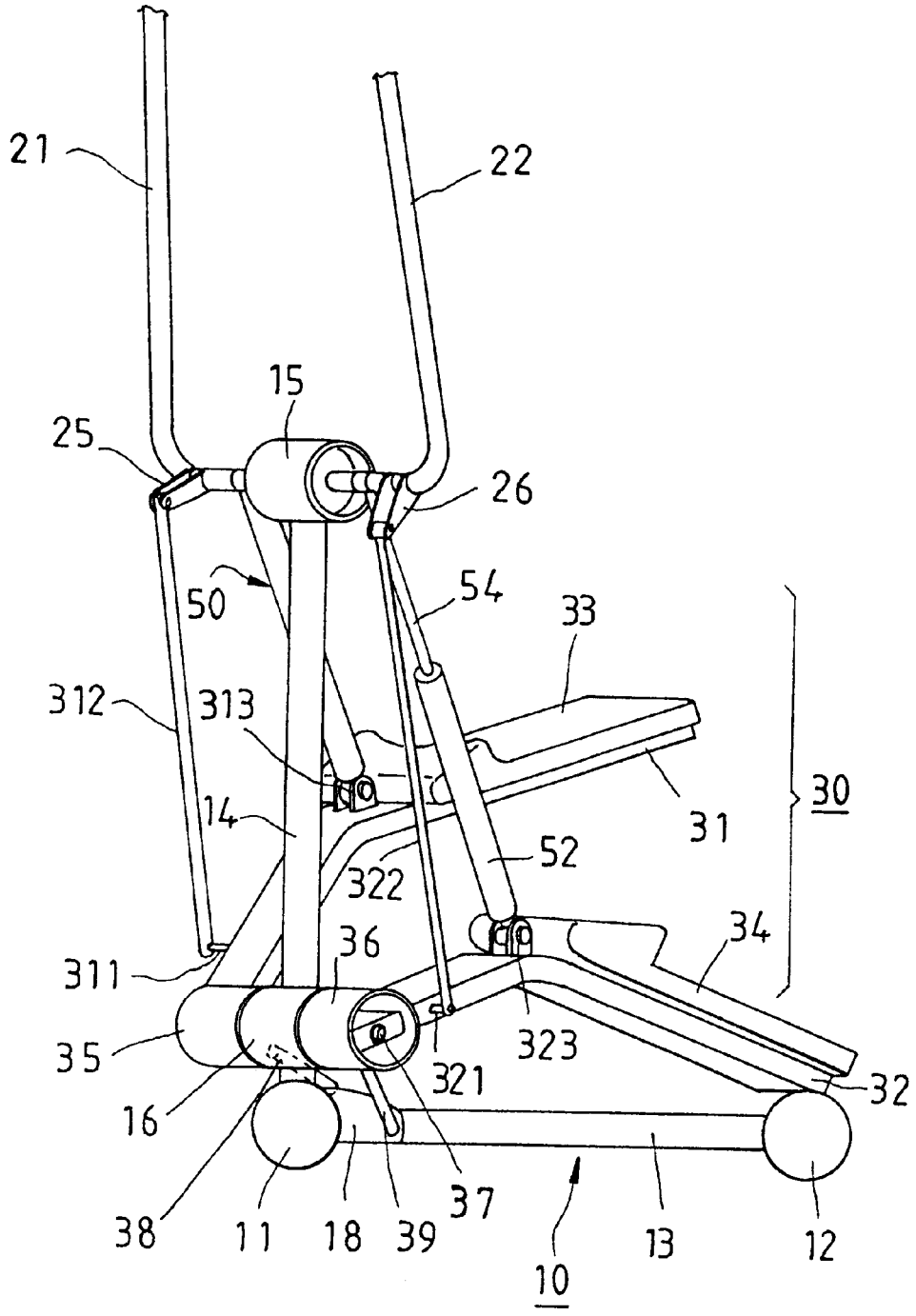
FIG. 2 shows a front view of the preferred embodiment of the present invention.

As shown in FIGS. 1 and 2, an exercise device of the preferred embodiment of the present invention comprises mainly a base 10, two pedaling sets 30, and two damping apparatus 50.

The base 10 is formed of a front cross rod 11, a rear cross rod 12 parallel to the front cross rod 11, and a connection rod 13 connecting the front cross rod 11 and the rear cross rod 12. The base 10 is securely rested on a ground or floor surface. The front cross rod 11 is provided at the midpoint thereof with a rotatable shaft 14 which is fastened pivotally therewith such that the rotatable shaft 14 can be turned in all directions. The rotatable shaft 14 is provided at the top end thereof with a top cross tube 15 fastened therewith, and at the bottom end thereof with a bottom cross tube 16 fastened therewith. The top cross tube 15 is provided at both ends thereof with a first handle 21 and a second handle 22, which are fastened pivotally with the top cross tube 15. The two handles 21 and 22 are respectively provided at the free end thereof with a grip 23 (24), which is in turn provided with a protective jacket made of a sponge material. The base 10 is provided with two arcuate protrusions 17 and 18 which are located at two opposite sides of the connection point of the front cross rod 11 and the connection rod 13. The first arcuate protrusion 17 is extended from the right side of the front cross rod 11 toward the support rod 13 and is provided with an edge slanting gradually from the right toward the left and having an outer point 17*a* and an inner point 17*b*. The second arcuate protrusion 18 is extended from the left side of the front cross rod 11 toward the support rod 13 and is provided with an edge slanting gradually from the left toward the right and having an outer point 18*a* and an inner point 18*b*.

The two pedaling sets 30 comprise two curved support rods 31 and 32. The first support rod 31 is provided with a first pedal 33 mounted thereon, whereas the second support rod 32 is provided with a second pedal 34 mounted thereon. The support rods 31 and 32 are provided respectively at the front end thereof with a pivoting tube 35 (36), by means of which the support rods 31 and 32 are fastened pivotally with both ends of the bottom cross tube 16 in conjunction with a pivoting element 37 on which the two support rods 31 and 32 turn up and down. In the meantime, the two support rods 31 and 32 swivel horizontally in relation to the rotatable shaft 14. The pivoting tube 35 (36) is provided with a guide pillar 38 (39) which is provided in the outer periphery thereof with a plastic protective jacket 40 fitted thereover. The protective jacket 40 is resistant to wear. The support rods 31 (32) is provided in the outer side of the front end thereof with a pin 311 (321) which is pivoted with one end of a connecting rod 312 (322). The connecting rod 312 (322) is fastened at other end thereof with a lug 25 (26) of the handle 21 (22). As a result, the two support rods 31 and 32 of the two pedaling sets 30 are linked with the two handles 21 and 22.

The two damping apparatus 50 are formed of two oil pressure cylinders 51, 52, and two piston rods 53, 54 which are provided at one end thereof with a round hole for fastening pivotally the piston rods 53, 54 with the two handles 21, 22. The two support rods 31 and 32 are provided with a pivoting lug 313 (323) contiguous to the front end of the pedal 33 (34) for fastening pivotally with the oil pressure cylinder 51 (52). The two pedals 33 and 34 are thus provided with a load of a predetermined magnitude to facilitate the training of legs of a user of the exercise device of the present invention.

In operation, the user of the exercise device of the present invention steps on the two pedals 33 and 34, with both hands of the user holding firmly the grips 23 and 24 of the two handles 21 and 22. As the pedals 33 and 34 are moved up and down by both legs of the exerciser, both hands of the exerciser are forced to move back and forth. When the second pedal 34 is moved downward, the first pedal 33 is forced to move up, and vice versa.

Figure 3:
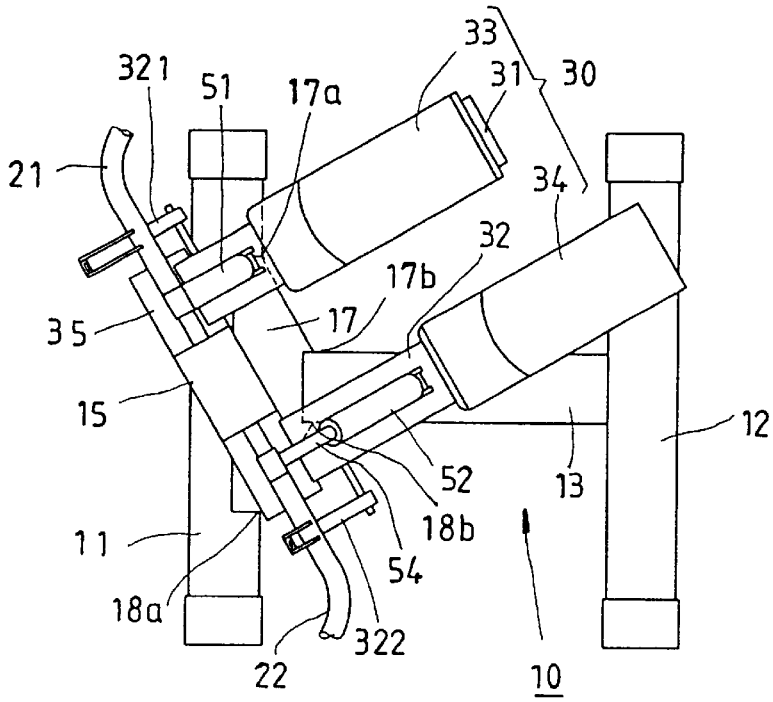
FIG. 3 is a top view showing that one of the two pedaling sets of the preferred embodiment of the present invention is forced to move downward.
Figure 4:
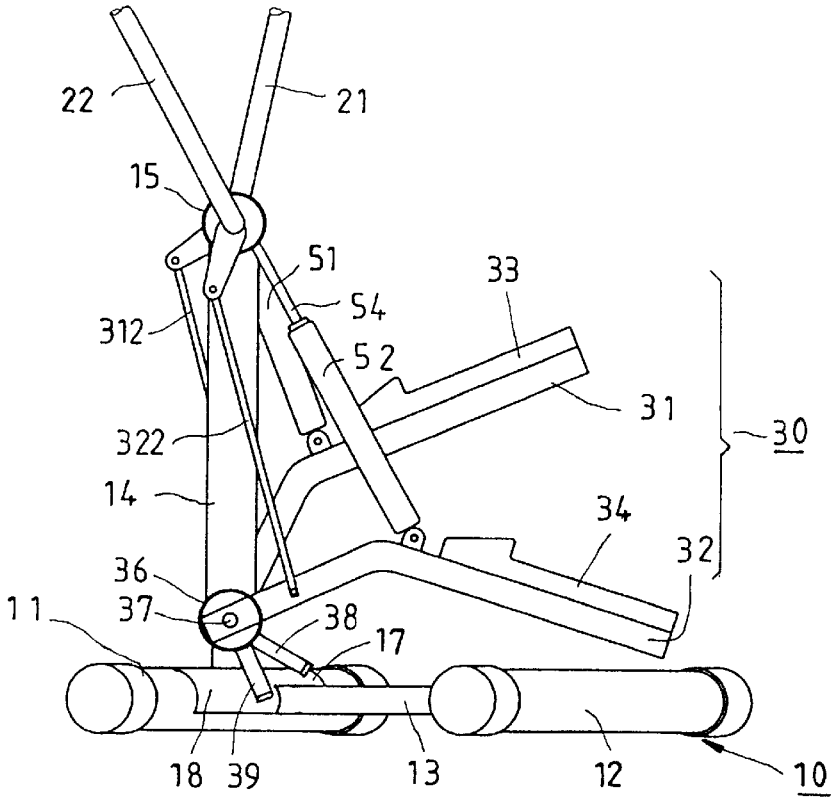
FIG. 4 shows a side schematic view of the present invention as shown in FIG. 3.
Figure 5:
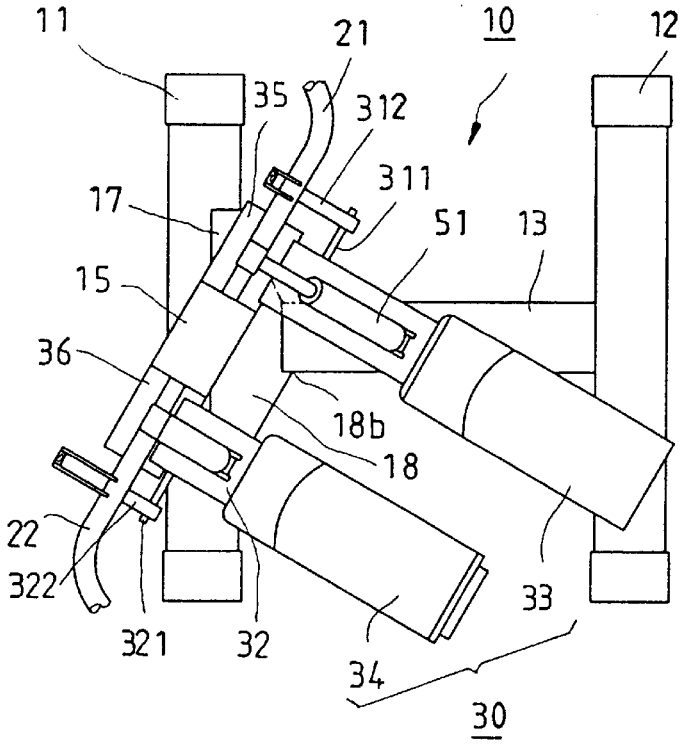
FIG. 5 is a top view showing that other one of the two pedaling sets of the preferred embodiment of the present invention is forced to move downward.
Figure 6:
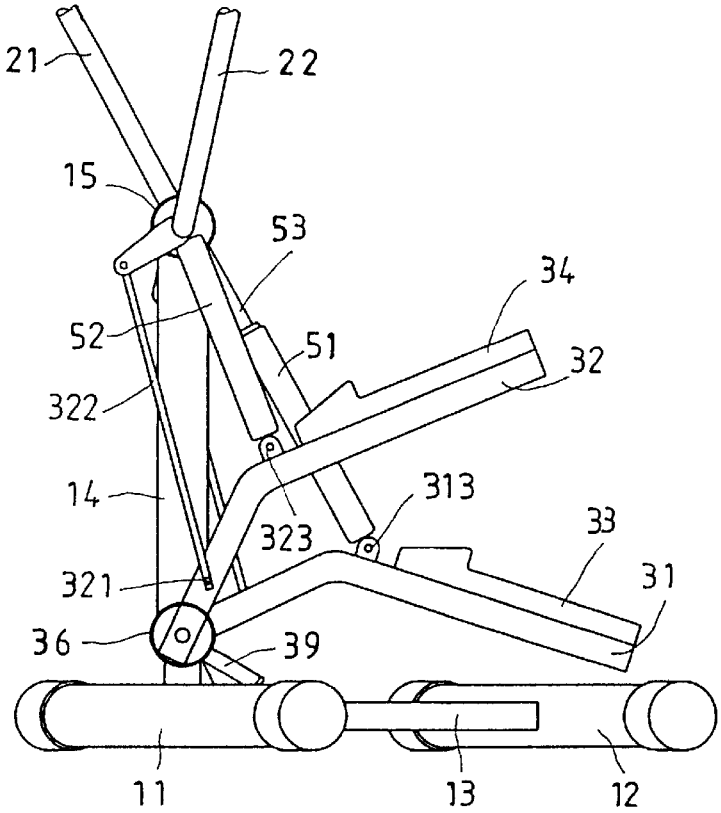
FIG. 6 shows a side schematic view of the present invention as shown in FIG. 5.

As shown in FIGS. 3 and 4, when the second pedal 34 is forced to move down, the second handle 22 is pushed forward, thereby causing the piston rod 54 of the second oil pressure cylinder 52 to be pulled out. In the meantime, the second guide pillar 39 of the second support rod 32 slides from the outer point 18*a* toward the inner point 18*b* of the second arcuate protrusion 18 until the guide pillar 39 is stopped at the inner point 18*b* of the second arcuate protrusion 18. The second pedal 34 thus swivels rightward. In light of the first pedal 33 being fastened pivotally with the second pedal 34, the first pedal 33 is forced to swivel rightward along with the second pedal 34. In the meantime, the piston rod 53 of the first oil pressure cylinder 51 is compressed. When the first handle 21 is pulled backward, the guide pillar 38 is caused to swivel rightward and upward to press against the outer point 17*a* of the first arcuate protrusion 17. Now referring to FIGS. 5 and 6, when the first pedal 33 is forced to move down by other leg of the exerciser, the first handle 21 is pushed forward, thereby causing the piston rod 53 of the first oil pressure cylinder 51 to extend. In the meantime, the first guide pillar 38 slides from the outer point 18*a* toward the inner point 18*b* of the first arcuate protrusion 17 of the base 10, thereby causing the first pedal 33 to swivel from the right to the left. The second pedal 34 is caused to swivel along to the left. The guide pillar 39 is caused to swivel to the left such that the guide pillar 39 is stopped by the outer point 18*a* of the second arcuate protrusion 18 of the base 10.

The first pedal 33 and the second pedal 34 of the exercise device of the present invention can be caused to move leftward and rightward while they are moved up and down, thanks to the cooperation of the pillars 38 and 39 of the two pedaling sets 30 with the two arcuate protrusions 17 and 18 of the base 10. It is therefore readily apparent that the device of the present invention is relatively simple in construction, and that the component parts of the device of the present invention are not susceptible to becoming jammed.

What is claimed is:

1. A device for exercising waist and legs simultaneously, said device comprising:

a base formed of a front cross rod, a rear cross rod parallel to said front cross rod, and a connection rod connecting said front cross rod and said rear cross rod, said front cross rod provided at a midpoint thereof with a rotatable shaft fastened pivotally therewith; and two pedaling sets comprising a first support rod, a second support rod, a first pedal mounted on said first support rod, and a second pedal mounted on said second support rod, said two pedaling sets being fastened pivotally with said rotatable shaft;

wherein said rotatable shaft turns in a direction perpendicular to said base so as to cause said two pedaling sets to turn horizontally in relation to said rotatable shaft; wherein said base is provided with a first arcuate protrusion and a second arcuate protrusion which are located at two sides of a connection point of said front cross rod and said connection rod, said first arcuate protrusion having an edge slanting from the left to the right, said second arcuate protrusion having an edge slanting from the right to the left; wherein said first support rod of one of said two pedaling sets is provided with a first guide pillar which slides along said first arcuate protrusion at such time when said first pedal is exerted on by an external force to move downward, thereby actuating said second pedal to swivel sideways; and wherein said first support rod of other one of said two pedaling sets is provided with a second guide pillar which slides along said second arcuate protrusion at such time when said second pedal is exerted on by an external force to move downward, thereby actuating said first pedal to swivel sideways.

2. The device as defined in claim 1, wherein said rotatable shaft is provided at a top end thereof with a top cross tube fastened therewith, and at a bottom end thereof with a bottom cross tube fastened therewith, said top cross tube being provided at both ends thereof with a first handle fastened pivotally therewith and a second handle fastened pivotally therewith, said bottom cross tube being provided at both ends thereof with said first support rod fastened pivotally therewith and said second support rod fastened pivotally therewith.

3. The device as defined in claim 2, wherein said first handle is connected with said first support rod by a first connecting rod; and wherein said second handle is connected with said second support rod by a second connecting rod.

4. The device as defined in claim 3, wherein said first handle and said first support rod are provided therebetween with a damping apparatus; and wherein said second handle and said second support rod are provided therebetween with a damping apparatus.

5. The device as defined in claim 4, wherein said damping apparatus comprises an oil pressure cylinder and a piston rod, with said oil pressure cylinder being fastened pivotally at one end thereof with said support rod, and with said piston rod being fastened pivotally at one end thereof with said handle.

6. The device as defined in claim 1, wherein said first guide pillar and said second guide pillar are provided with a plastic protective jacket fitted thereover.

* * * * *